US007070679B2

(12) United States Patent
Cason et al.

(10) Patent No.: US 7,070,679 B2
(45) Date of Patent: Jul. 4, 2006

(54) HIGH GLOSS AND HIGH BULK PAPER

(75) Inventors: David B. Cason, Paducah, KY (US); S. Craig Petro, Paducah, KY (US); Stig V. Renvall, Silver Spring, MD (US); Bhima Sastri, North Potomac, MD (US)

(73) Assignee: NewPage Corporation, Dayton, OH (US)

( * ) Notice: Subject to any disclaimer, the term of this patent is extended or adjusted under 35 U.S.C. 154(b) by 0 days.

(21) Appl. No.: 10/345,247

(22) Filed: Jan. 16, 2003

(65) Prior Publication Data

US 2003/0121634 A1 Jul. 3, 2003

Related U.S. Application Data

(60) Division of application No. 09/656,348, filed on Sep. 6, 2000, now Pat. No. 6,531,183, which is a continuation-in-part of application No. 09/362,141, filed on Jul. 28, 1999, now abandoned.

(51) Int. Cl.
*D21H 19/38* (2006.01)
*D21H 19/72* (2006.01)

(52) U.S. Cl. ..... 162/136; 162/135; 162/204; 162/205

(58) Field of Classification Search ..... 162/135, 162/136, 204–206, 164.1; 428/211, 212, 428/218, 215, 341, 532, 535, 536, 537.5, 428/340–342
See application file for complete search history.

(56) References Cited

U.S. PATENT DOCUMENTS 3,124,480 A 3/1964 Mahoney et al. ..... 118/60
4,010,307 A 3/1977 Canard et al. ..... 428/327
4,468,498 A 8/1984 Kowalski et al.
4,469,825 A 9/1984 Kowalski et al.
4,477,518 A 10/1984 Cremona et al.
4,594,363 A 6/1986 Blankenship et al.
4,624,744 A 11/1986 Vreeland ..... 162/206
4,677,003 A 6/1987 Redlich et al.
4,829,102 A 5/1989 Biale
4,885,320 A 12/1989 Biale
4,916,171 A 4/1990 Brown et al.
4,920,160 A 4/1990 Chip et al.
5,026,782 A 6/1991 Biale
5,030,666 A 7/1991 Kowalski et al.
5,053,441 A 10/1991 Biale (Continued)

FOREIGN PATENT DOCUMENTS

CA 2238466 5/1998

(Continued)

OTHER PUBLICATIONS

"Calculation of Hip Width, Penetration and Pressure for Contact between Cylinders With Elastomeric Covering", TAPPI, Oct. 1978, vol. 61 No. 10, pp. 115-118.

(Continued)

*Primary Examiner*—Eric Hug
(74) *Attorney, Agent, or Firm*—Thompson Hine LLP

(57) ABSTRACT

The invention teaches a method of manufacturing a high bulk, high gloss paperweb using a supercalender operation. A paperweb surface is coated with a plastic pigment. The paperweb is run through a multi-nip calender device wherein the nip load of the paperweb is maintained at a load of about 1,000 pounds per linear inch at each nip. The temperature of the hard rolls are about 450 degrees Farenheit or less.

6 Claims, 4 Drawing Sheets

U.S. PATENT DOCUMENTS

| | | | | |
|---|---|---|---|---|
| 5,075,153 | A | 12/1991 | Malhotra | |
| 5,135,568 | A | 8/1992 | Fasano | |
| 5,169,715 | A | 12/1992 | Maubert et al. | |
| 5,212,251 | A | 5/1993 | Lorah et al. | |
| 5,283,129 | A | 2/1994 | Renk et al. | 428/537 |
| 5,304,707 | A | 4/1994 | Blankenship et al. | |
| 5,342,649 | A | 8/1994 | Sarokin | |
| 5,360,657 | A | 11/1994 | Kano et al. | 428/207 |
| 5,403,894 | A | 4/1995 | Tsai et al. | |
| 5,438,920 | A | 8/1995 | Koivukunnas et al. | 100/162 |
| 5,478,631 | A | 12/1995 | Kawano et al. | |
| 5,494,971 | A | 2/1996 | Blankenship | |
| 5,508,072 | A | 4/1996 | Andersen et al. | |
| 5,510,422 | A | 4/1996 | Blankenship et al. | |
| 5,527,613 | A | 6/1996 | Blankenship et al. | |
| 5,624,743 | A | 4/1997 | Malhotra | |
| 5,792,317 | A | 8/1998 | Taylor et al. | |
| 6,242,047 | B1 * | 6/2001 | Johnson et al. | 427/361 |
| 6,254,725 | B1 | 7/2001 | Lau et al. | 162/135 |
| 6,280,830 | B1 * | 8/2001 | Nakanishi et al. | 428/211.1 |
| 6,410,158 | B1 * | 6/2002 | Johnson et al. | 428/532 |
| 6,630,229 | B1 * | 10/2003 | Normington et al. | 118/123 |

FOREIGN PATENT DOCUMENTS

| | | |
|---|---|---|
| WO | WO 9820201 | 5/1998 |

OTHER PUBLICATIONS

"Rubber Roll Hardness-Another Look", Pulp & Paper, Mar. 18, 1968, pp. 30-32.

"Hollow-Sphere Polymer Pigment in Paper Coating", by J. E. Young, published in TAPPI, May 1985, vol. 68, No. 5, pp. 102-105.

Plastic Pimgments in Paper Coatings, by B. Aluice and P. Lepoutre, published in TAPPI, May 1980, vol. 63, No. 5 pp. 49-53.

"Light Reflectance of Spherical Pigments in Paper Coatings", by J. Borch and P. Lepoutre, TAPPI, Feb. 1978, vol. 61, No. 2, pp. 45-48.

Lightweight Coated Magazine Papers, published in paper Magazine, vol. 186, No. 1, pp. 35-38.

"Supercalendering and Soft Nip Calendering Compared", by John D. Peel, published in TAPPI, Oct. 1991, pp. 179-186.

* cited by examiner

HIGH GLOSS AND HIGH BULK PAPER

CROSS RELATED APPLICATIONS

This application is filed as a divisional application of application Ser. No. 09/656,348 filed on Sep. 6, 2000, issued as U.S. Pat. No. 6,531,183, which is a continuation-in-part of application Ser. No. 09/362,141 filed Jul. 28, 1999, now abandoned. The entire disclosures of both applications are herein incorporated by reference.

FIELD OF INVENTION

The invention relates to a method of manufacturing a high-gloss, high-bulk paper product.

BACKGROUND OF THE INVENTION

After a paperweb is formed it typically undergoes further treatment to modify its properties. One typical process is to calender the paper web. The paperweb is passed through a calender which typically comprises a series of nips formed between one or more pairs of rolls. The calender conventionally smoothes the surface of the paperweb. During the calendaring process, the thickness or caliper of the paper web is reduced and the paperweb is densified. The density of the resulting paperweb is typically calculated as:

Density=Basis Weight/Caliper where the basis weight is the weight of a ream of the paperweb, in pounds, and the caliper is the thickness of the paperweb, measured in thousandths of an inch, or points. Since calendering generally reduces caliper, paper that is calendered has a higher density than uncalendered paper. The bulk of the paper is inversely related to density, therefore when the density is increased, the bulk of the paper will be reduced.

Calendering is typically performed using a gloss calender, soft calender or supercalender. The gloss calender is typically comprised of a hard, non-resilient, heated roll made, for example, of steel, positioned proximally to a soft roll so as to form a narrow gap or nip. As the paperweb passes through the calender nips it is exposed to a nip load in the range of from about 100 to about 900 pounds per lineal inch (pli). Nip pressures in gloss calenders are usually in the range of less than about 2000 pounds per square inch (psi). A wide range of processing temperatures can be used in a gloss calender, with the typical high temperature being in the range of about 450° F.

The finishing effect achieved using a gloss calender, however, is not as smooth or flat and therefore not as glossy as the surface produced using higher pressures on the paperweb. It is conventionally known to increase the nip load or the roll temperature, or both, to plasticize and smooth the surface layers of the paperweb. Such modifications are incorporated, for example, in the design and operation of a conventional soft calender. The soft calender is usually constructed as having one to two nips per coated side, or as a two or four-nip device, with each nip being formed between a heated hard roll and an unheated soft roll.

An alternative method is to use a supercalender wherein the paperweb is sequentially passed between a series of nips formed between vertically stacked rolls of a supercalender. The supercalender typically comprises a frame having an upper roll and a lower roll with intermediate rolls positioned in between. The rolls of the supercalender may be heated hard rolls or unheated soft rolls, in serial or alternating arrangement. The nips formed between the rolls are typically shorter than those of a soft calender or gloss calender. The upper temperature range of the heated rolls in the supercalender is usually about 250° F. As the paperweb is passed through each nip, the paperweb is compacted to form paper of substantially uniform density and high gloss. The high pressure of superclander however causes a reduction in the paperweb's bulk. In a supercalender, the nips are loaded initially by gravity, i.e., gravitational forces acting on the weight of the rolls produces weight distribution from the upper nip to the bottom nip that is substantially linear and increasing. This has the consequence that the load present in the bottom nip actually determines the minimum loading capacity of the calender.

Paper grades are often sold by surface area; thus a lower density sheet provides more surface area per ton of paper. This arrangement is often advantageous for both the manufacturer and the buyer. Thus it will be appreciated that a manufacturing method that provide a desired surface finish on the paperweb without substantially affecting its bulk is desirable. Conventional supercalender have difficulty maintaining more bulk in the paperweb because such a process requires relatively high initial nip loads and corresponding nip pressures, which often increase as the paperweb moves through the calender. A typical 10–12 roll supercalender device will produce a minimum load on the bottom nip in excess of about 1000 pli which could translate to a nip pressure greater than about 2500 psi depending upon the nip width. Furthermore, to achieve some calendering potential from the upper nips, additional external load must be applied to the rolls. For example, where the initial nip load may be about 1000 pounds per linear inch (pli) as the paperweb enters the first nip, it is then exposed to subsequent nip loads at each of the successive intervening nips before passing through a final nip at a cumulative nip load of about 2000–3000 pli. This amount of pressurization in combination with heat results in a paperweb that is highly densified with a high gloss surface. While the paperweb has a good finish it results in increase web density and loss of paperweb bulk. A comparison between supercalendering and gloss calendering is reported in the article entitled "Supercalendering and Soft Nip Calendering Compared", by John D. Peel, TAPPI Journal, October 1991, pp. 179–186.

A recent development in the calendering art addresses the problem of increasing linear loads at the successive nips in a supercalender. U.S. Pat. No. 5,438,920 describes a modified calender that is comprised of a series of rolls similar to a conventional supercalender. However the loading at each nip can be controlled by way of relief means that partially or completely relieve the nip loads produced by the masses of the intermediate rolls. As the paperweb passes through this calender, there is less variation in the nip load and nip pressure that is applied at each nip. As a result, there is less reduction in the bulk of the finished paper. This patent does not, however, teach or suggest making a high gloss paper of reduced bulk. Laid-open Canadian Patent Application 2238466AA, filed Dec. 20, 1998, teaches using another type of modified calender with reduced nip loads at each nip to make an ultra-light weight coated (ULWC) paper, which is a high-bulk glossed paper.

It is known in the papermaking art that various coating formulations and coating ingredients may be used in the manufacture of paper to achieve high gloss. For example, U.S. Pat. No. 5,283,129 discloses a lightweight paper stock that is coated with a pigment composition. U.S. Pat. No. 4,010,307 discloses a high gloss coated paper product comprising calcium carbonate and a non-film forming polymeric pigment. U.S. Pat. No. 5,360,657 discloses a high gloss paper with a thermoplastic polymeric latex applied to paper before calendaring. Laid-open Canadian Patent Application CA 2238466AA describes the manufacture of an ultra light weight (ULWC) paper by applying a plastic coating pigment onto a base paper containing 60% weight or more mechanical pulp. The coated paper is then calendered at a nip loading less than conventional supercalendering nip loading, to produce a product having a bulk factor above 51 if a supercalender is used, and a bulk factor above 60 if a hot-soft calender is used. The maximum TAPPI 75° gloss achieved for ULWC paper using the invention of CA 2238466AA was reported as 35, while the inventors reported producing lightweight coated paper of lesser bulk having a maximum gloss value of 45. PCT published application WO 98/20201 discloses a method of making paper having high brightness and gloss by applying a coating comprising at least 80 parts precipitated calcium carbonate and at least 5 parts of an acrylic styrene copolymer hollow sphere plastic pigment, based on 100 parts total weight of pigment, before finishing the coated paper to achieve gloss development. The finishing process does not involve using a modified supercalender, and the resulting paper is not a high bulk product. Hollow sphere pigments have also been used to produce a non-gloss finish. U.S. Pat. No. 5,902,453 teaches applying a coating containing 30–60% weight hollow sphere particle pigments and 40–70% weight cationic starch binder to a web, then calendering, under unspecified conditions, to yield a product with an uncoated appearance rather than a gloss finish. In an article entitled "Lightweight Coated Magazine Papers," published in the Jul. 5, 1976 issue of the magazine PAPER, Vol. 186, No. 1, at pages 35–38, a relationship between calendering and the use of plastic pigments in coatings is disclosed. Other publications, including the articles entitled "Light Reflectance of Spherical Pigments in Paper Coatings," by J. Borch and P. Lepoutre, published in TAPPI, February 1978, Vol. 61, No. 2, at pages 45–48; "Plastic Pigments in Paper Coatings," by B. Aluice and P. Lepoutre, published in TAPPI, May 1980, Vol. 63, No. 5, at pages 49–53; "Hollow-Sphere Polymer Pigment in Paper Coating," by J. E. Young, published in TAPPI, May 1985, Vol. 68, No. 5, at pages 102–105, all recognize the use of polymer pigments in paper coatings.

What is needed is a method of manufacturing using a supercalender that results in a high bulk paper with a high gloss surface.

SUMMARY OF THE INVENTION

The invention teaches a method of manufacturing a high bulk, high gloss paperweb using a supercalender operation. A paperweb surface is coated with a plastic pigment. The paperweb is run through a multi-nip calender device wherein the nip load of the paperweb is maintained at a load of about 1,000 pounds per linear inch at each nip. The temperature of the hard rolls are about 450 degree Farenheit or less.

DETAILED DESCRIPTION OF THE INVENTION

The method of the invention produces a paper product having a relatively high bulk, therefore producing a thicker sheet of paper with a smooth high gloss surface. As used herein, "paper product" includes all varieties of finished paper or paperboard materials. The term "high gloss" means a TAPPI gloss value of greater than 60, as determined at a 75° angle of reflectance.

According to the invention, a coating formulation is applied to the surface of the paper. The paper may be a dried web or sheet of material formed at least partially from a pulp. Preferably, the pulp is comprised mainly of chemical pulp, but the furnish may contain, if desirable, other types of pulp including mechanical pulp, semi-chemical pulp, recycled pulp, pulp containing other natural fibers, synthetic fibers, and any combination thereof. The paper of the invention typically, however, contain less than 60% by weight of mechanical pulp. The paper may be of any suitable fiber composition having a uniform dispersion of cellulosic fibers alone or in combination with other fiber materials, such as natural or synthetic fiber materials. Examples include previously coated or uncoated paper of a weight ranging from about 37 to about 115 lbs./ream. For example, the substrate may be a 115 lbs./ream paper stock manufactured by MeadWestvaco Corporation.

Figure 1A:
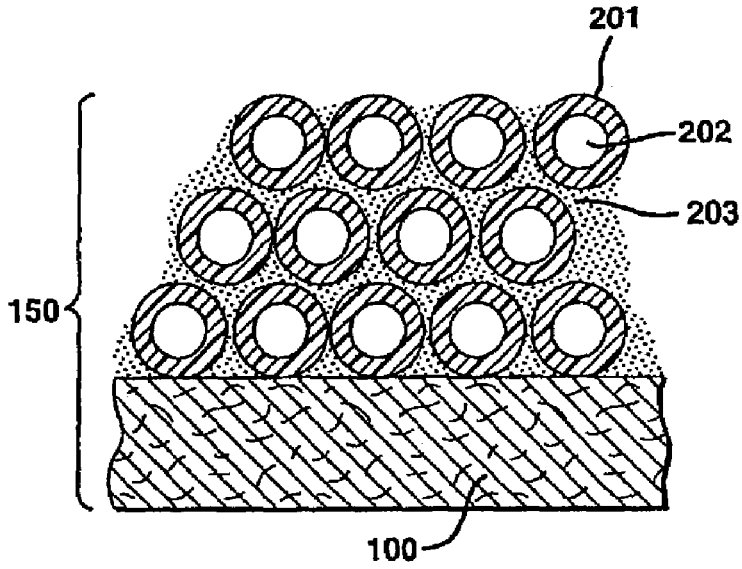
FIG. 1*a* is a cross-sectional representation of a paperweb coated with hollow polymer pigment particles according to the invention.
Figure 1B:
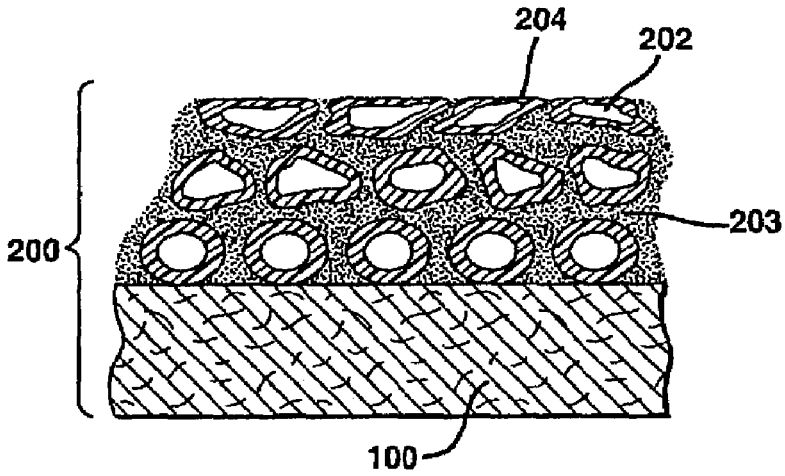
FIG. 1*b* is a cross-sectional representation of the paperweb of FIG. 1*a* after calendering according to the invention.

FIG. 1*a* illustrates a coating formulation comprising a suitable vacuolated or solid particulate plastic pigment. During the finishing process, the surfaces of the particulate plastic pigment are compacted into an orientation parallel to the plane of the surface of the paper as illustrated in FIG. 1*b*. The surfaces of the polymer particles provide a smooth layer and therefore increase reflectance of light, and, accordingly, glossiness of the coated, finished surface. While solid particulate plastic pigments may be used, preferably, the plastic pigment is comprised of vacuolated particles of a suitable polymer material. The term "vacuolated" means that the pigment particles include one or more hollow voids or vacuoles within the particle. For example, the particle may be formed with a single void at its core, as a hollow sphere, or it may include several voids. When the vacuolated particles are pressed during a finishing operation such as calendering, the vacuoles are not completely flattened (FIG. 1*b*), and accordingly, a higher bulk is retained after compaction than would be achieved using a non-particulate pigment, or after using a pigment in the form of solid particles without voids. The particulate plastic pigment used is suitably of a size to permit the desired gloss development, the particle diameter being restricted only by the limitations of the process used in manufacturing the pigment, and any limitations imposed by printing requirements for the paper product. Particle sizes may therefore be 0.1 micron or more in diameter, for example, up to or exceeding about 1.0 micron.

Suitable vacuolated pigments include polystyrenes and acrylic polymers, including, but not limited to, methylmethacrylate, butyl-methacrylate and alphamethyl styrene. The particulate plastic pigment may be used as a latex, preferably in an aqueous medium. An example of a particulate pigment is "HP-1055", which is a hollow sphere pigment commercially available from Rohm & Haas. This pigment is made of styrene-acrylic copolymer, and has a particle diameter of about 1.0 micron. The amount of particulate plastic pigment in the coating formulation may range from about 10 parts by weight to about 50 parts by weight, based on the total dry weight of pigment. Preferably, the amount of particulate plastic pigment used is from about 14 parts by weight to about 25 parts by weight, based on the total dry weight of pigment.

Optionally, the coating formulation may further comprise a second particulate plastic pigment, which may be in the form of solid or vacuolated particles of varying size, for example from about 0.20 to about 0.45 micron in diameter. This second pigment may be blended with the first particulate plastic pigment to provide optimal light-scattering properties, such as opacity, without loss of bulk and gloss. The coating formulation may additionally contain ground or precipitated calcium carbonate as a pigment. Examples of such materials include HYDROCARB 90 and COVERCARB, supplied commercially by Omya, and ALBAGLOSS S, available from Specialty Minerals Inc. Typically, up to about 90 parts by weight of calcium carbonate, based on the total dry weight of the dry pigment, may be added. Preferably, the amount added is from about 30 parts to about 70 parts by weight of the total weight of dry pigment.

The coating formulation may optionally include clay as an added pigment. The brightness of the clay may be selected based on the brightness requirement for the finished product, and, accordingly, high or regular brightness clay may be used. Such clays may include No. 1 or No. 2 clays and kaolin clay. Examples of these are HYDRAFINE 90, available commercially from J. M. Huber Corporation, and ALPHACOTE and PREMIER No. 1 from English China Clay Inc. Preferably, regular or high brightness kaolin clay is used. The amount of clay that may be added to the coating formulation of the present invention may be up to about 90 parts by weight, preferably from about 10 parts by weight up to about 40 parts by weight, based on the total weight of the dry pigment. Other conventional additives, such as binders, opacifiers, whitening agents, pigments, starch, polyvinyl alcohol (PVA), polyvinyl acetate (PVAc), styrene-butadiene latex, carboxymethylcellulose (CMC), titanium dioxide ($TiO_2$), calcined clay, optical brighteners, tinting agents, dyes, dispersants and insolubilizers may be included in the coating formulation.

The coating formulation may be formulated by mixing together the various ingredients in a one-tank makedown or by pre-mixing then combining separate ingredients. When used, starch or PVA is pre-cooked before it is combined with the other ingredients. The mixture is continually agitated to homogenize the ingredients. The resulting formulation may be of a viscosity ranging from about 1000 cPs to about 6000 cPs, preferably from about 2000 cPs to about 4000 cPs (Brookfield No. 4 spindle, 20 rpm). The solids content of the coating composition when it is used, for example, in a blade coater, may desirably be as high as from about 60% to about 75% by weight; however, because the plastic pigment is typically added to the formulation in the form of an aqueous dispersion having a low solids content, the solids content of the coating formulation is more usually in the range of from about 40% to about 60% by weight. While the range of pH is limited only by the type of additives included in the formulation, it is recognized that the pH of the coating formulations may typically range from about 7 to about 10.

Figure 2:
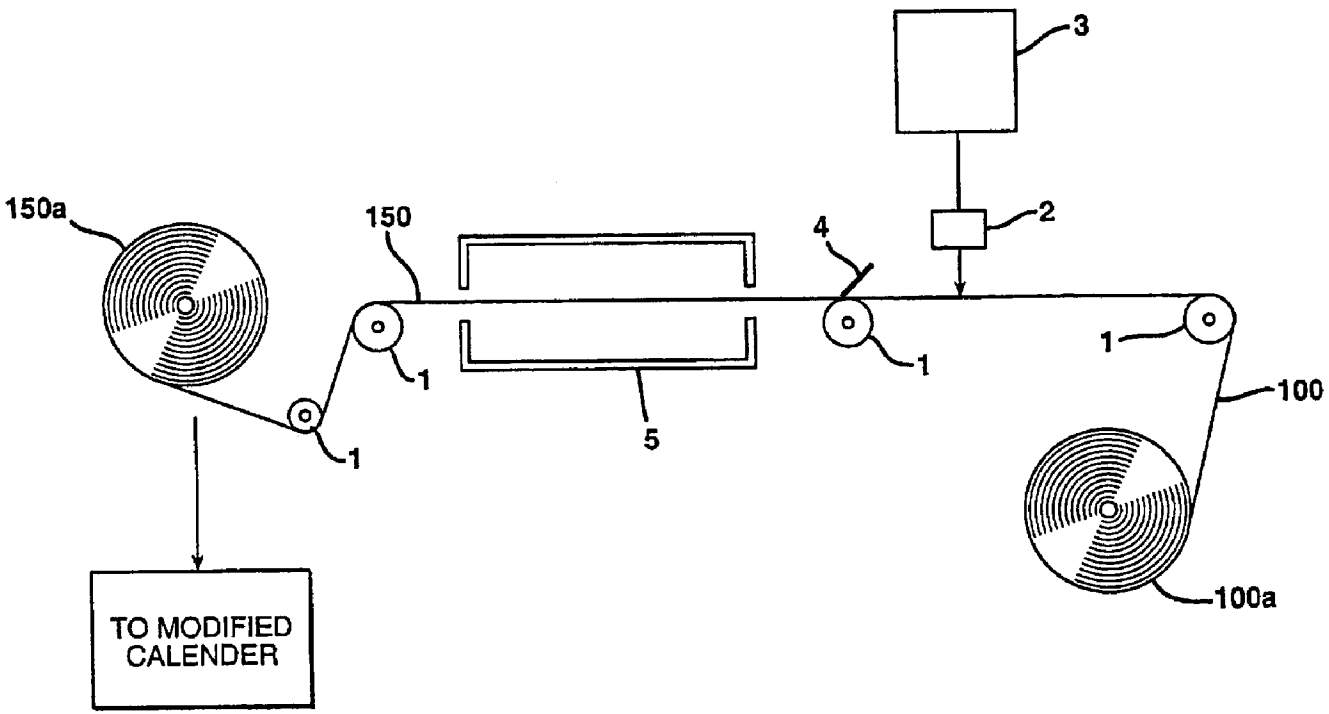
FIG. 2 illustrates a process for coating a paperweb according to the invention.

The coating formulation may be applied to either one side (C1S) or both sides (C2S) of a base stock substrate in an amount that, when dried, provides maximum gloss without negatively affecting print quality when the paper is printed. FIG. 2 illustrates an apparatus for applying the coating to the paper. The coating formulation is exemplary applied at a dry coat weight of from about 2.5 lbs./ream/side to about 12 lbs./ream/side, where the ream size is about 3300 $ft^2$. Preferably the coating formulation is applied at a dry coat weight of from about 7 lbs./ream/side to about 9 lbs./ream/side on an uncoated sheet of base stock having a basis weight higher than 100 lbs./ream, and at from about 5 lbs./ream/side to about 8 lbs./ream/side on an uncoated base stock sheet of lower basis weight. The coating formulation may be applied as a single layer alone, or in multiple layers, or as the final, surface layer atop one or more other coating layers. For example, on a pre-coated sheet containing from about 3 lbs./ream/side to about 8 lbs./ream/side of a previously applied coating, the coating formulation may be applied atop the first coating, on the same side, at a coat weight of about 2 lbs./ream/side to about 9 lbs./ream/side. The total dry weight of the coating so formed may be from about 5 lbs./ream/side to about 17 lbs./ream/side, using either light or heavy basis weight substrates. Regardless of which of the foregoing options is selected, the coating formulation of the invention is preferably applied to achieve a final basis weight of from about 50 lbs./ream/side to about 200 lbs./ream in the finished product. The coating formulation may be applied by any conventionally known means, including, but not limited to, bar or rod coating, knife or doctor blade coating, roll coating, spray coating, flooding or any combination thereof. The coating formulation is preferably applied to at least one side of paper using a blade coater, in a substantially uniform thickness over the surface of the base stock.

As illustrated in FIG. 1*a*, the coating formulation, when applied to the paper 100, forms a layer illustrated as hollow particles 201, each particle having a hollow core or vacuole 202. The remainder of the coating layer is comprised of binders, additional pigments and other additives, as described above, which form a matrix 203 around the particles 201. After calendering, as illustrated in FIG. 1*b*, the particles are compressed such that the layer forms a relatively smooth surface 204.

Preferably, the coating process is carried out off-line or in-line. FIG. 2 illustrates an exemplary method. A rolled paperweb 100*a* is illustrated as being unwound 100 and passed via guides 1 through a coating apparatus such as a blade coater, which may include a delivery means 2, a reservoir 3 and a metering device, for example a doctor blade 4. The delivery means 2 for transferring the coating formulation to the web may, for example, be a rotating roll, pump or gravity-fed pipe in flow communication with the reservoir 3, which, in turn, may be continually replenished from a mixing tank (not shown). The reservoir 3 is ideally agitated constantly to maintain homogeneity of the formulation. In the coating step, the paperweb 100 is contacted with the delivery means 2, whereby the coating formulation is continuously deposited on the surface of the base stock 100. Excess coating formulation is removed as the base stock 100 then passes under the doctor blade 4, which is set at an angle to the paperweb 100 to provide a scraping action that removes the excess coating formulation from the surface of the paperweb 100 and evenly distributes the remaining coating formulation across the surface. The angle of the doctor blade 4 may be adjusted depending on the desired thickness of the coating. After the coating is applied and the excess removed, the coated paperweb 150 may optionally be passed through a drier apparatus 5, such as an oven, infrared drier or other drying device, in which the coating is dehydrated and solidified onto the web surface. Any conventional method may be used, with the operating temperature selected according to the line speed, amount and thickness of coating, the water content and the temperature sensitivity of the coating ingredients. For example, the coated paperweb stock 150 may be passed, at a line speed of about 500 to 5000 feet per minute, through an oven maintained at about 200° F. to about 500° F.

Figure 3:
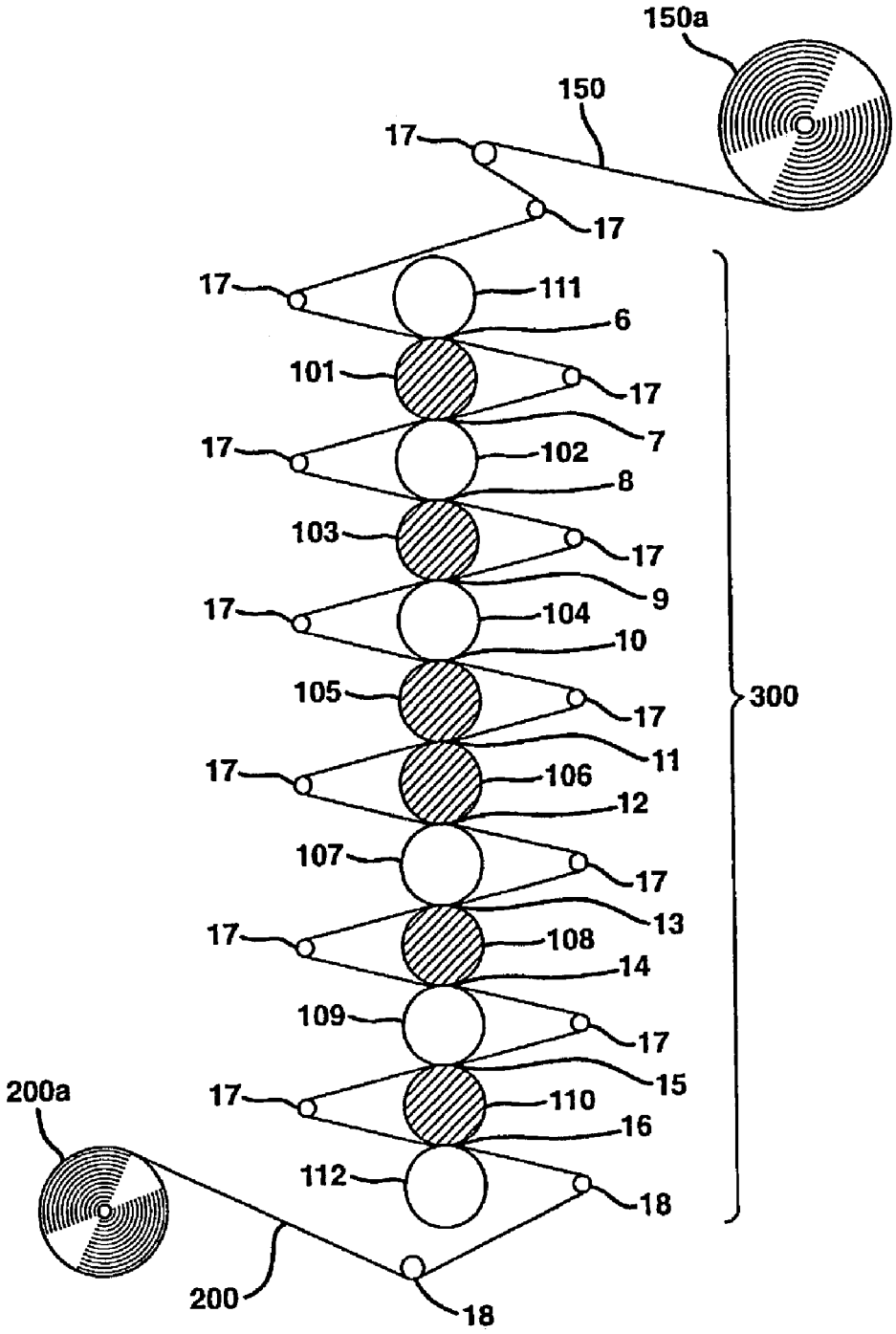
FIG. 3 illustrates a calendaring operation for the coated paperweb according to the invention.

After the coating formulation is applied and dried, the coated paperweb 150 may be reformed as a roll 150*a* or in any other suitable form (not shown) for subsequent use. Alternatively, the coated paperweb 150 may be formed and then immediately finished in an in-line process. In an exemplary embodiment, as shown in FIG. 3, the coated paperweb 150 is unwound from roll 150*a*, then drawn through a modified calender 300. Suitably, the modified calender 300 is a multi-nip supercalender comprising a linear arrangement of from 6–14 hard and soft rolls. The linear arrangement of the rolls may be vertical, inclined or horizontal. For example, as illustrated in FIG. 3, such a calender is comprised of a series of intermediate rolls 101–110 that are vertically aligned between an upper roll 111 and a lower roll 112, in which the arrangement of the rolls has been modified to provide a substantially uniform load at each successive nip. As used herein, "substantially uniform" means that there is minimal variation, no more than 0–100 per linear inch, between the nip loads measured at each nip throughout the calender. Examples of such calenders are the modified supercalenders disclosed in U.S. Pat. No. 5,438,920, the entire disclosure of which is incorporated herein by reference. By using the modified calender, it is possible to control or manipulate the load at each nip in a calender stack, and if desired, run higher loads in the top of the calender stack and lower loads at the bottom compared to conventional supercalenders. Commercial examples of such supercalenders are those manufactured commercially by Valmet, Inc. under the brand name "OPTI-LOAD", or by Voith Sulzer GmbH.

The modified calender 300 may be equipped with from 5 to 13 nips, preferably from 9 to 11 nips, each nip being formed between a pair of rolls. The rolls 101–112 may be either hard or soft rolls. Hard rolls 102, 104, 107, 109, 111 and 112 may typically have an outer surface formed of steel or other non-corrosive non-yielding conductive material that may be heated or chilled. The soft rolls 101, 103, 105, 106, 108 and 110 may be surfaced with a polymer coating, fiber or other pliable material. The upper, lower and intermediate rolls may typically be crown-compensated such that the load is varied across the machine width of the roll for fine-tuning of the web substrate caliper profile.

The calendering step of the present invention may be performed at line operating speeds of from about 500 feet per minute to about 5000 feet per minute with one or more hard rolls being heated to a temperature of up to about 450° F., preferably from about 150° F. up to about 240° F. Suitably, the initial, intermediate and final nip pressures are maintained at less than about 2500 psi, as determined by the Raybestos—Manhattan modification of the Hertzian equation, as set forth in the article, Schmidlin, H. L., "Rubber Roll Hardness—Another Look," Pulp and Paper, Mar. 18, 1968, pp. 30–32; see also Deshpande, N. V., "Calculation of Nip Width, Penetration and Pressure for Contact between Cylinders with Elastomeric Covering," TAPPI October 1978, Vol. 61 No. 10, pp. 115–118. According to this formula:

$$P_n = L/n$$

$$n = [4LTD_1D_2/E(D_1+D_2)]^{1/2}$$

where $P_n$ is the specific nip pressure in pounds per square inch (psi), L is the nip load in pounds per lineal inch (pli), n is the nip width in inches, $D_1$ and $D_2$ are the diameters, in inches, of the rolls forming the nip, T is the thickness, in inches, of the soft roll cover, E is the elastic modulus of the soft roll in the nip (psi), and m is an exponential factor, which may be calculated based on the roll diameters.

Referring again to FIG. 3, the coated paperweb 150 enters the modified calender 300 and is drawn through a first nip 6 set at a nip load, for example, of approximately 600 pli. This initial load may suitably be varied from about 200 to about 2500 pli, to provide the desired gloss and density. The web 150 is subsequently passed through a series of nips 7–15, via guides 17, then through a final nip 16, the load at each nip being substantially uniform in relation to the other nips in the series. The calendered paper product 200 may then be passed over one or more guides 18 and wound, via any conventional means, into a roll 200*a*, or otherwise packaged. The finished paper product may be subjected to any number of conventional post-finishing operations, such as printing, cutting, folding and the like, depending on the intended use.

Figure 4:
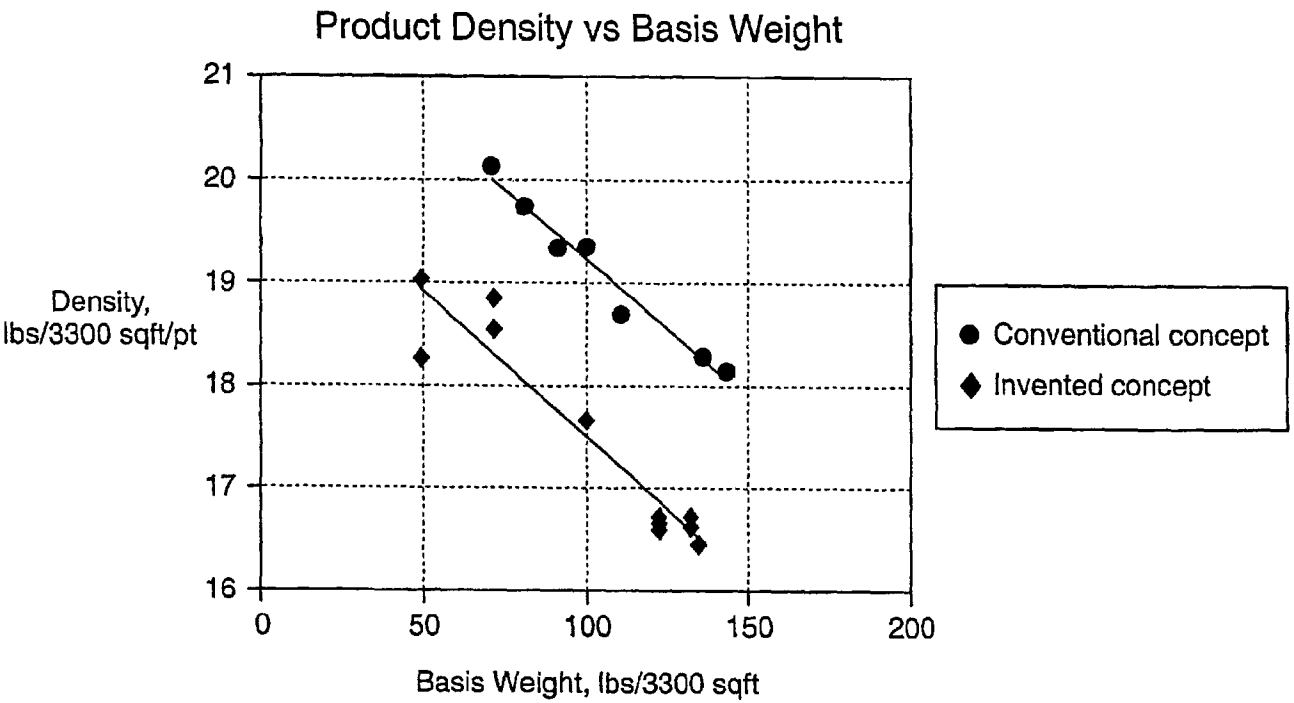
FIG. 4 is a graph illustrating the calendered paperweb density in relation to the paperweb basis weight according to the invention.

The use of a modified multi-nip calender in combination with the use of coating formulations containing more than 10 parts by weight of a vacuolated plastic pigment, based on the total weight of the dry coating composition, allows the papermaker to produce a bulky sheet with a high gloss surface. The invention, in this respect, may be used to produce paper products having a density ranging from about 15.5 lbs./ream/pt to about 20 lbs./ream/pt, in relation to a basis weight of from about 50 lbs./ream to about 150 lbs./ream, while at the same time having a TAPPI gloss level, at 75° reflectance, of from about 60 to about 90. These results are graphically represented in FIG. 4.

The following examples are representative of, but are in no way limiting as to the scope of the invention.

EXAMPLES

Example 1

In Examples 1–4, three coating formulations A–C were prepared and coated separately or in combination onto a 37 lbs./ream paper, which was then finished under various coating and finishing conditions. Each coating was formulated according to Table 1.

| Formulation | Parts by weight A | B | C |
|---|---|---|---|
| Premier[a] | 30 | | |
| KCS[b] | | 90 | |
| Alphacote[c] | 30 | | |
| Hydrocarb CC[d] | 30 | | 80 |
| HC-60[d] | | 10 | |
| Finntitan RDE2[e] | 7.5 | | |
| HP-1055[f] | 2.5 | | 20 |

[a]#1 clay, ECC Inc.
[b]#2 clay, ECC Inc.
[c]high brightness clay, ECC Inc.
[d]calcium carbonate, Omya Inc.
[e]titanium dioxide, Kemira Inc.
[f]hollow sphere styrene-acrylic plastic pigment, 1.0 micron diameter, Rohm & Haas The coating formulations were then applied to both sides of a paper at a total coating weight of about 7 lbs./ream per side at a coating speed of 4500 fpm. In this regard, where multiple coatings were applied, the total coating weight was approximately 7 lbs./ream per side. The coating alternatives included: (a) applying a single layer coating on each side of the web with a jet applicator blade metering coater; or (b) applying a first coating layer of 3 lbs./ream on each side with a film coater, followed by a second top coating layer of 4 lbs./ream on each side with a jet applicator blade metering coater. Each of the coated papers was then subjected to either calendering with a conventional supercalender or a modified supercalender according to the invention as described above with regards to FIG. 4. The conventional supercalender was a 12-roll supercalender equipped with "DURAHEAT" (Valmet) roll covers, commercially available from Valmet Inc., on the soft rolls, and heated steel hard rolls. The modified supercalender was a 12-roll "OPTILOAD" (Valmet) modified supercalender equipped with DURAHEAT (Valmet) soft rolls and heated steel hard rolls, operated at nip loads of 132, 265, 532, 800 and 1066 pli throughout all the nips, respectively.

Gloss and density of the coated paper were measured and the results reported in Table 2:

X—OPTILOAD model 11-nip load-modified supercalender, Valmet Paper Machinery. These table illustrates that using a top coating formulation in a modified calendering process according to the invention yielded a product of approximately 50 lbs./ream basis weight, having a gloss value determined at 75° of greater than 65 and a density of less than 19 lbs./rm./pt, or, alternatively, a gloss value of 80 and a density of less than 20 lbs./rm./pt. To achieve corresponding gloss quality using a conventional coating and calendering method, a resulting sheet density of 20 lbs./ream/pt or higher would be obtained.

Example 2

Samples of low density 8 pt glossy cover grade (Examples 5–8) were prepared using two coating formulations, D and E, applied to a 120 lbs./ream base paper stock (Westvaco) using a Valmet blade coater. Coating formulation D was a comparative sample having a relatively minor amount of plastic pigment, which included 55 parts by weight PREMIER #1 high brightness clay (ECC), 35 parts by weight HC90 calcium carbonate (Omya), 5 parts by weight of HP-1055 hollow plastic sphere pigment (Rohm & Haas) and 5 parts by weight TIONA 4000 titanium dioxide ($TiO_2$) whitening pigment (Millennium Chemicals). Coating formulation E included 50 parts by weight ALBAGLOSS S, a precipitated calcium carbonate (Specialty Minerals), 30 parts PREMIER #1 high brightness clay (ECC) and 20 parts by weight HP-1055 hollow plastic sphere pigment (Rohm & Haas). The samples were then calendered using a conventional calender or using a modified calender according to the invention. The conventional supercalender configuration included polymer-covered DURASOFT rolls (Valmet) instead of paper or cotton soft rolls. Nip loads in the bottom nip were determined to be 1269 and 1813 pli. The modified supercalender was an OPTILOAD 12-roll model, available from Valmet Paper Machinery. The nip load in each nip was 450, 908, 1269 or 1949 pli.

The resulting products were evaluated as to density and gloss. The results are shown in Table 3:

| SAMPLE | Formulation | Coating Means | Calendering Means | Nip Load (pli) | Nip Pressure (psi) | Density (lbs./ream/pt) | TAPPI Gloss (75°) |
|---|---|---|---|---|---|---|---|
| 1 | A | Blade | Conventional | 1155 | 2468 | 20.4 | 72.6 |
| | | | Supercalender | 1511 | 2923 | 20.4 | 75.3 |
| | | | | 1867 | 3340 | 20.6 | 78.4 |
| 2 | A | Blade | Optiload | 265 | 977 | 19.0 | 61.7 |
| | | | Calender[X] | 532 | 1515 | 19.6 | 69.5 |
| | | | | 800 | 1959 | 20.6 | 77.8 |
| | | | | 1066 | 2347 | 20.9 | 80.3 |
| 3 | B, A* | Film + | Optiload | 265 | 977 | 19.9 | 63.2 |
| | | Blade | Calender[X] | 532 | 1515 | 20.4 | 69.5 |
| | | | | 800 | 1959 | 21.4 | 77.5 |
| | | | | 1066 | 2347 | 21.5 | 79.1 |
| 4 | B, C* | Film + | Optiload | 132 | 630 | 18.2 | 67.4 |
| | | Blade | Calender[X] | 265 | 977 | 19.2 | 84.1 |
| | | | | 532 | 1515 | 19.9 | 87.8 |

*layers of each formulation applied in sequence shown

| SAMPLE | Coating Formulation | Coating Means | Calendering Means | Nip Load (pli) | Nip Pressure (psi) | Density (lbs./ream/pt) | TAPPI Gloss (75°) |
|---|---|---|---|---|---|---|---|
| 5 | D (Comparative Sample) | Blade | Conventional Supercalender | 1269 | 2619 | 16.7 | 50 |
| | | | | 1813 | 3272 | 16.9 | 59 |
| 6 | D (Comparative Sample) | Blade | Optiload Calender[X] | 1269 | 2619 | 17.3 | 66 |
| | | | | 1949 | 3696 | 17.8 | 75 |
| 7 | B | Blade | Conventional Supercalender | 1269 | 2619 | 16.2 | 66 |
| | | | | 1813 | 3272 | 16.7 | 73 |
| 8 | E | Blade | Optiload Calender[X] | 450 | 1313 | 15.9 | 67 |
| | | | | 908 | 2121 | 16.4 | 75 |
| | | | | 1269 | 2619 | 17.0 | 77 |
| | | | | 1949 | 3696 | 17.7 | 80 |

X-OPTILOAD 11-nip load-modified supercalender, Valmet Paper Machinery.

The results illustrate that an 8 pt cover grade with a gloss of 75 (TAPPI 750) and a density below 16.5 pounds per ream per caliper point (lbs./rm./pt) was produced using a coating containing approximately 20 parts by weight of a hollow sphere plastic pigment in a multi-nip calender operating at reduced nip pressure.

Many variations and modifications of the invention will become obvious to those skilled in the art once presented with the disclosure herein. Accordingly, it will be understood that all such embodiments that are within the scope of the appended claims are intended to be encompassed by the present disclosure and claims.

The invention claimed is:

1. A finished paper product formed by the method comprising the steps of:

coating at least one side of a paper substrate with a coating comprising a hollow particulate plastic pigment; and passing the coated paper through a multi-nip calender device, wherein said calender device comprises at least three or more hard rolls and at least three or more soft rolls in an alternating arrangement, the interface between one hard roll and one soft roll forming a nip, wherein said calender device has at least five nips, each of said at least five nips applying a nip load on the coated base stock of about 1000 pounds per linear inch or less such that said nip load is substantially uniform at each nip with respect to others of said at least five nips, and wherein the surface temperature of each hard roll does not exceed about 450° F. to form a product having a TAPPI 75° gloss value of greater than 60 with a density range of about 15.5 pounds per ream per caliper point at a basis weight of about 150 pounds per ream to a density of about 20 pounds per ream per caliper point at a basis weight of about 50 pounds per ream.

2. A paper product comprising:

a hollow particulate plastic coating, wherein said paper product has a basis weight ranging from about 50 lbs./ream to about 75 lbs./ream, a density of less than about 19 pounds per ream per caliper point and a TAPPI 75° gloss value of greater than 60.

3. A paper product comprising:

a hollow particulate plastic coating, wherein said paper product has a basis weight ranging from about 75 lbs./ream to about 100 lbs./ream, a density of less than about 18.5 pounds per ream per caliper point and a TAPPI 75° gloss value of greater than 60.

4. A paper product comprising:

a hollow particulate plastic coating, wherein said paper product has a basis weight ranging from about 100 lbs./ream to about 150 lbs./ream, a density of less than about 18 pounds per ream per caliper point and a TAPPI 75° gloss value of greater than 60.

5. The paper product of claim 4 having a density of less than about 17 pounds per ream per caliper point and a TAPPI 75° gloss value of about 65 to about 85, wherein the basis weight of the product is from about 110 lbs./ream to about 150 lbs./ream.

6. A paper product comprising:

a hollow particulate plastic coating, wherein said paper product has a density of from about 15.5 pounds per ream per caliper point to about 16.3 pounds per ream per caliper point and a TAPPI 75° gloss value of from about 60 to about 90.

* * * * *